US005180876A

United States Patent [19]

Thorward

[11] Patent Number: 5,180,876

[45] Date of Patent: Jan. 19, 1993

[54] STRING INSTRUMENT TUNING GUARD

[76] Inventor: Nora J. Thorward, 1125 Loma Ave. #157, Coronado, Calif. 92118

[21] Appl. No.: 714,560

[22] Filed: Jun. 13, 1991

[51] Int. Cl.[5] ..... G10D 1/12

[52] U.S. Cl. ..... 84/293

[58] Field of Search ..... 84/293, 297 R, 304

[56] References Cited

U.S. PATENT DOCUMENTS 4,829,870 5/1989 Ralston ..... 84/293

4,840,102 6/1989 Pittman ..... 84/293

*Primary Examiner*—Michael L. Gellner

*Assistant Examiner*—Cassandra C. Spyrou

*Attorney, Agent, or Firm*—Leon Gilden

[57] ABSTRACT

A tuning guard is arranged for presentation between the string members of a string instrument and the instrument tuner head to provide protection against marring, scratching, and the like during a tuning procedure. The organization includes a series of apertures for receiving the tuning studs therethrough, with intercommunicating slits for providing appropriate flexure and accommodation of the rods. A modification of the invention includes adhesive members for effecting the securement of the organization, as well as torroidal ring members mounted to a bottom surface of the guard impregnated with a lubrication oil for effecting of impregnating the tuning rods with a lubricant to minimize corrosion and adhere to the string members relative to the rods.

3 Claims, 4 Drawing Sheets

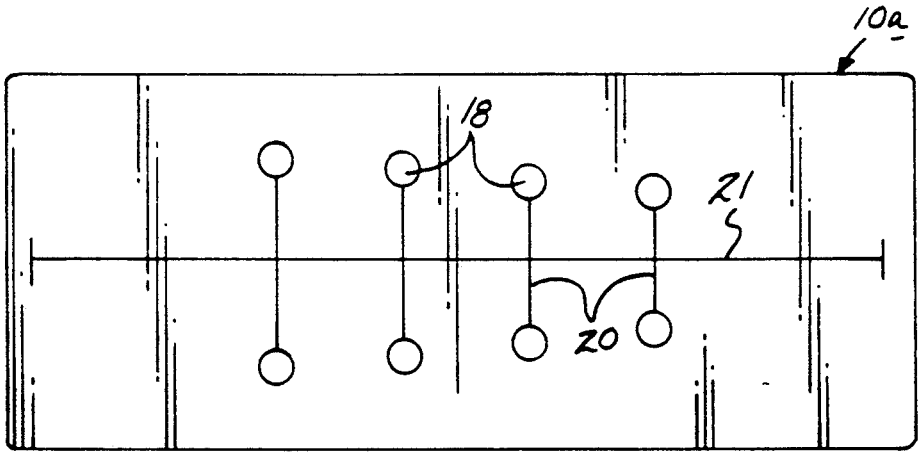
Fig 3
Fig 4
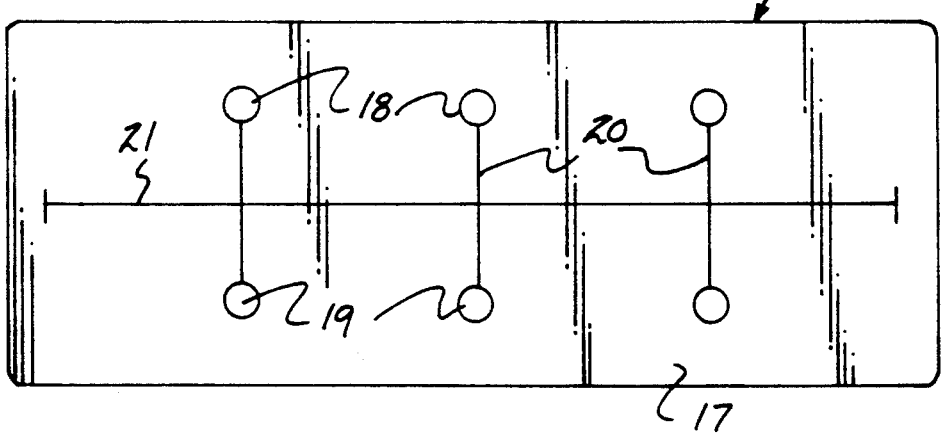
Fig 5
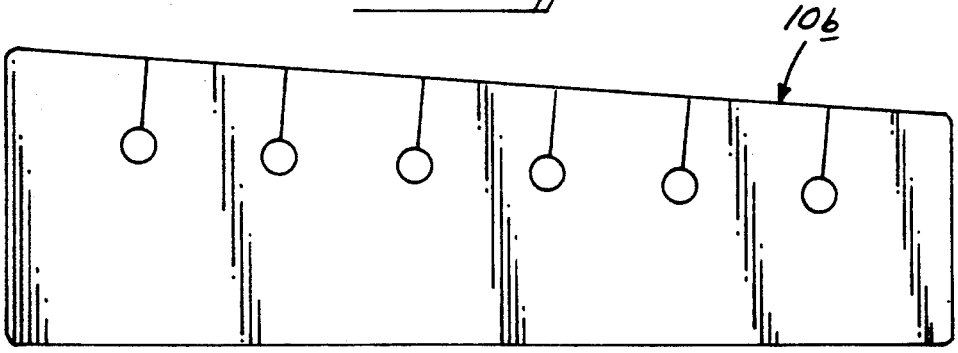

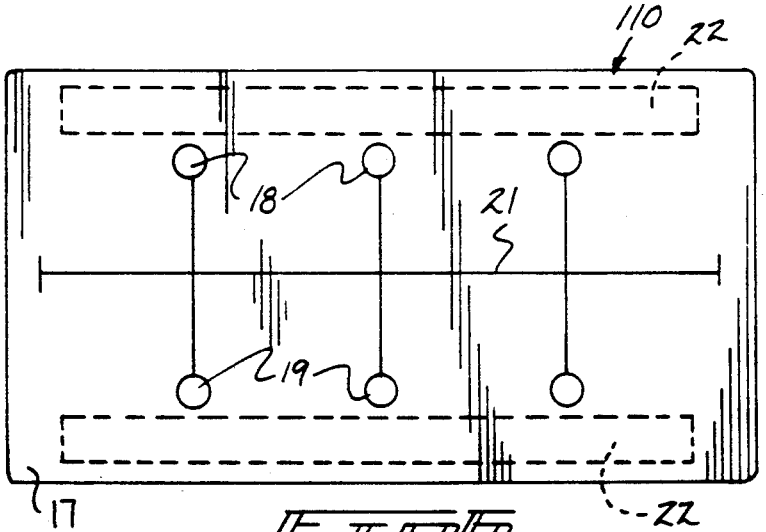
Fig 6
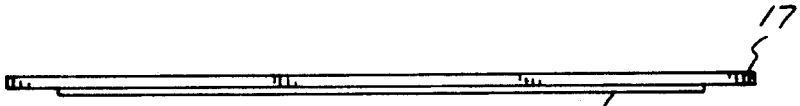
Fig 7
Fig 8
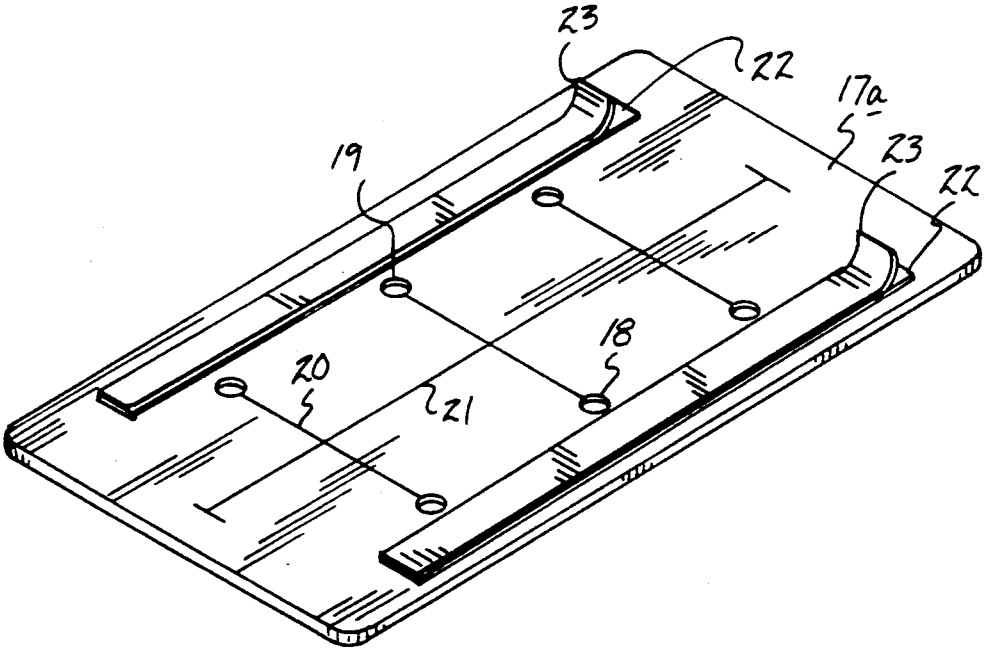

STRING INSTRUMENT TUNING GUARD

BACKGROUND OF THE INVENTION

1. Field of the Invention

The field of invention relates to tuning apparatus, and more particularly pertains to a new and improved string instrument tuning guard wherein the same is arranged for providing protection to a string instrument during a tuning procedure.

2. Description of the Prior Art

Various protectors and the like are provided in the prior art for affording protection to instruments. In tuning procedures, however, an individual's fingers and associated rings, cuff links, and the like are positioned adjacent the tuning head during the tuning procedure. The instant invention is arranged for providing a guard that is readily removed subsequent to positioning in a tuning procedure. Examples of the prior art include U.S. Pat. No. 3,251,258 to Parker wherein a string instrument utilizes a guard arranged for positioning onto the body of a string instrument for protecting the instrument in a supported orientation.

U.S. Pat. No. 4,000,678 to Messine sets forth a cover for a musical instrument, wherein the cover receives a body of the instrument for affording protection thereto.

In a similar manner, U.S. Pat. No. 4,177,847 to Spindler and U.S. Pat. No. 3,877,501 to Toth provide covers or jacket members arranged for positioning about the body portion of a string instrument.

As such, it may be appreciated that there continues to be a need for a new and improved string instrument tuning guard as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of instrument tuning apparatus now present in the prior art, the present invention provides a string instrument tuning apparatus wherein the same provides protection for a string instrument during a tuning procedure. As such, the general purpose of the present invention, which will be described subsequently in greater detail, is to provide a new and improved string instrument tuning guard which has all the advantages of the prior art instrument tuning apparatus and none of the disadvantages.

To attain this, the present invention provides a tuning guard arranged for presentation between the string members of a string instrument and the instrument tuner head to provide protection against marring, scratching, and the like during a tuning procedure. The organization includes a series of apertures for receiving the tuning studs therethrough, with intercommunicating slits for providing appropriate flexure and accomodation of the rods. A modification of the invention includes adhesive members for effecting the securement of the organization, as well as torroidal ring members mounted to a bottom surface of the guard impregnated with a lubrication oil for effecting of impregnating the tuning rods with a lubricant to minimize corrosion and adhere to the string members relative to the rods.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved string instrument tuning guard which has all the advantages of the prior art string instrument guard apparatus and none of the disadvantages.

It is another object of the present invention to provide a new and improved string instrument tuning guard which may be easily and efficiently manufactured and marketed.

It is a further object of the present invention to provide a new and improved string instrument tuning guard which is of a durable and reliable construction.

An even further object of the present invention is to provide a new and improved string instrument tuning guard which is susceptible of a low cost of manufacture with regard to both materials and labor, and which accordingly is then susceptible of low prices of sale to the consuming public, thereby making such string instrument tuning guards economically available to the buying public.

Still yet another object of the present invention is to provide a new and improved string instrument tuning guard which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top orthographic view of the guard member utilized for receiving tuning rods in a generally trapezoidal configuration, such as in a mandolin.

FIG. 4 is a top orthographic view of the invention as typically utilized in guitar apparatus.

FIG. 5 is an orthographic view of the organization for use in a string instrument with a co-linear arrangement of tuning apertures directed therethrough.

FIG. 6 is a top orthographic view of a modification of the instant invention.

FIG. 7 is an orthographic side view of the instrument set forth in FIG. 6.

FIG. 8 is an isometric bottom view of the invention, as set forth in FIG. 6.

DESCRIPTION OF THE PREFERRED EMBODIMENT

Figure 1:
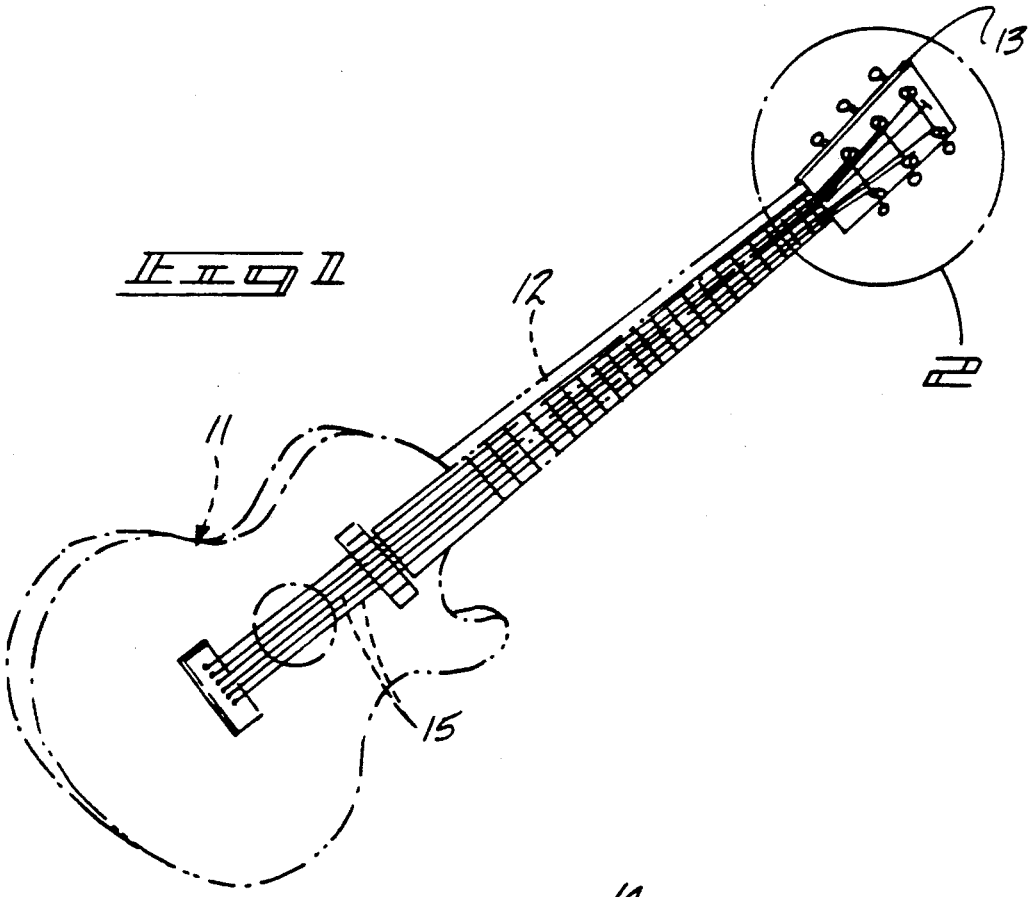
FIG. 1 is an isometric illustration of the invention in association with a string instrument.
Figure 2:
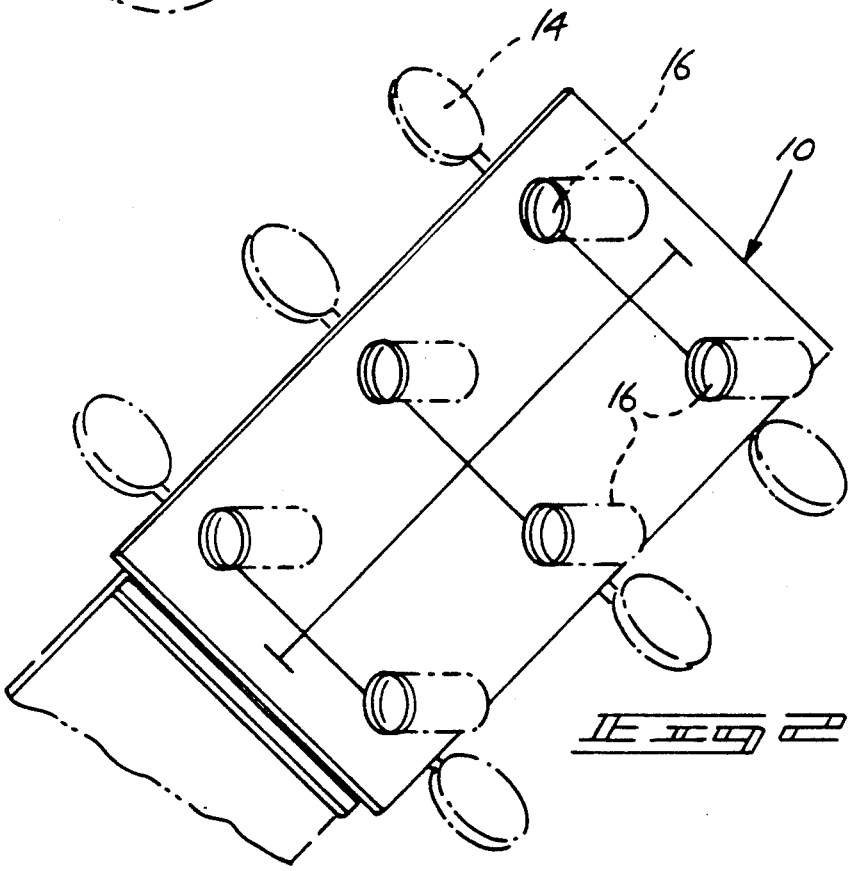
FIG. 2 is an orthographic view of the organization, as set forth in section 2 of FIG. 1.

With reference now to the drawings, and in particular to FIGS. 1 to 10 thereof, a new and improved string instrument tuner guard embodying the principles and concepts of the present invention and generally designated by the reference numeral 10 will be described.

More specifically, the string instrument tuning guard 10 of the instant invention essentially comprises cooperation with a striding instrument member 11 that includes an instrument neck 12 and a tuner head 13 mounted at an upper terminal end of the neck, with the tuner head 13 including a plurality of rotatably adjuster members 14 for adjusting tensioning of the string members 15, with the individual string member 15 mounted on an individual adjuster member. Adjusting rod 16 projects orthogonally relative to the top surface of the neck 12. A flexible support plate 17 is securable over the string members 15 and receives the adjuster rod 16 therethrough. The flexible support plate 17 includes a plurality of equally spaced apertures 18 defining a first row and a second row, wherein the first and second rows are arranged in a parallel relationship, as illustrated in FIG. 4 for example. In the use of a mandolin, as illustrated in FIG. 3, the device 10*a* is of a configuration to form a trapezoidal configuration utilizing the apertures 18, wherein FIG. 5 illustrates the use of a linear single line of apertures for use with a single line of tuning rods, such as may be seen and utilized on electric guitars.

The apertures 18 and 19 defining the parallel first and second rows include parallel connecting slits 20 directed radially of opposing apertures 18 and 19 of the rows. A medial slit 21 bisects the connecting slits 20 in an orthogonal relationship to permit flexure in reception of the various adjusting rods 16 through a respective aperture 18 and 19.

The FIGS. 6–8 illustrate the use of parallel adhesive strips 22 mounted to the bottom surface 17 of the flexible support plate to enhance securement of the organization as required, wherein the flexible plate may be folded to provide adherence of the adhesive strips to the sides of the tuner head 13 for example. A peel-away layer 23 is mounted in coextensive covering relationship relative to the adhesive strips 22 to provide exposure of the adhesive strips for the adhesive relationship, as noted above.

Figure 9:
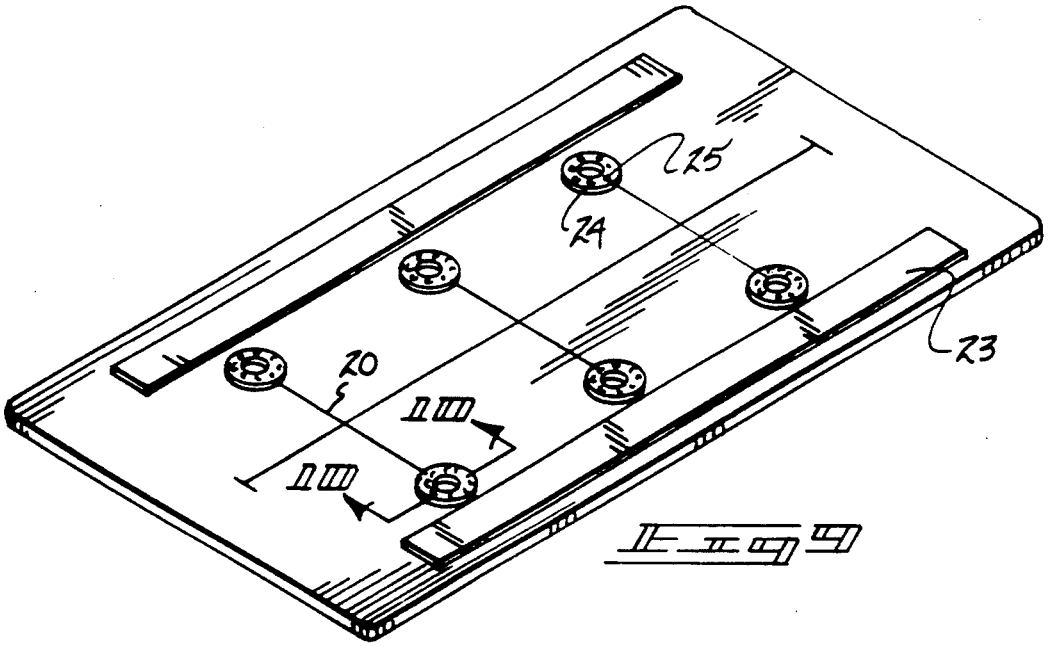
FIG. 9 is a further modified aspect of the invention, as set forth in FIG. 6.
Figure 10:
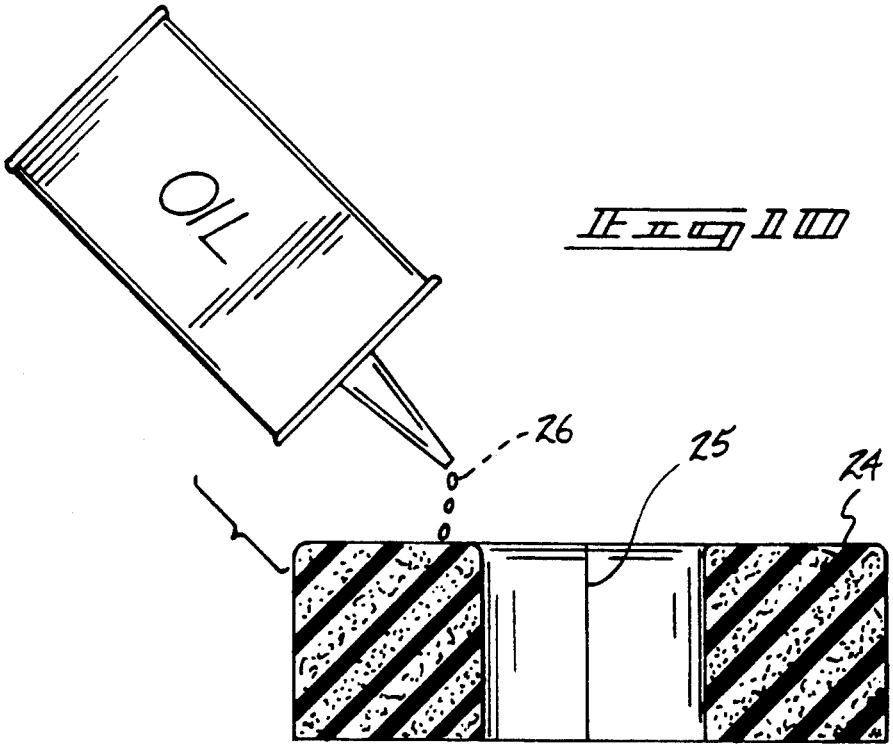
FIG. 10 is an orthographic view, taken along the lines 10—10 of FIG. 9 in the direction indicated by the arrows.

The invention as set forth in FIGS. 9 and 10 illustrate the use of a sponge torroidal ring member 24 in surrounding coaxial relationship relative to each of the apertures. The ring members 24 are mounted to the bottom surface 17*a* of the flexible plate 17, and each include a radial slot 25 coextensive with an associated connecting slit 20 to accommodate reception of an associated adjusting rod 16 therethrough. Lubrication oil 26 impregnates each of the ring members 24 for lubrication of the device to minimize adherence of the associated string member relative to an associated adjusting rod providing consistency of tonal qualities of the string members in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A string instrument tuning guard in combination with a string instrument member, wherein the string instrument member includes an instrument neck mounted to an instrument body, wherein the instrument neck extends exteriorly of the instrument body and terminates in an instrument tuner head, the tuner head includes a plurality of individual adjusting members rotatably mounted to the tuner head, with each of said adjusting members including an adjusting rod projecting from a top surface of the tuner head to provide a plurality of adjusting rods, each of said adjusting rods including a flexible string member wound thereabout for effecting musical tuning of each string member, wherein the guard apparatus includes, a flexible support plate, the flexible support plate includes at least a first row of equally spaced apertures, the apertures each receiving one of said adjusting rods therethrough for securement of the flexible support plate relative to the tuner head, and a second row of second apertures arranged parallel relative to the first row of apertures, and each of said apertures of the first row of apertures is aligned with a respective second aperture, with a connecting slit directed therebetween in a diametrically aligned relationship, and each connecting slit is arranged in a parallel relationship, and including a medial slit orthogonally bisecting the connecting slit to permit flexure of the support plate and apertures in receiving the adjusting rods therethrough.

2. An apparatus as set forth in claim 1 wherein the support plate includes a bottom surface, the bottom surface includes spaced side edges, and the bottom surface includes a plurality of adhesive strips, and an adhesive strip of the plurality of said adhesive strips mounted adjacent each of the side edges, and the adhesive strips each including a removable peel-away flexible layer coextensive with and in contiguous communication with the adhesive strips for permitting removal of each of said peel-away layer for exposure of said adhesive strips.

3. An apparatus as set forth in claim 2 wherein each of said apertures of the said first and second rows of apertures includes a sponge torroidal ring member coaxially mounted to the bottom surface in coaxial alignment with each of said apertures, wherein each ring member includes a radial slot, and each radial slot aligned with a respective connecting slit, and each ring member impregnated with a lubrication oil for effecting lubrication of each respective adjusting rod and associated string member would about each of said adjusting rods.

* * * * *